US008615860B2

(12) United States Patent
Cobzaru et al.

(10) Patent No.: US 8,615,860 B2
(45) Date of Patent: Dec. 31, 2013

(54) JAW GRIP FORCE ADJUSTMENT SYSTEM FOR OFFSET AND 90 DEGREE PULLING HEADS

(75) Inventors: Cristinel Cobzaru, Murrieta, CA (US); John Wilker, Huntington Beach, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 183 days.

(21) Appl. No.: 13/330,187

(22) Filed: Dec. 19, 2011

(65) Prior Publication Data

US 2013/0152354 A1 Jun. 20, 2013

(51) Int. Cl.
*B21J 15/20* (2006.01)
*B21D 31/00* (2006.01)

(52) U.S. Cl.
USPC ..... 29/243.521; 72/391.2; 29/243.522

(58) Field of Classification Search
USPC ..... 72/391.2, 391.6, 391.8; 29/243.521, 29/243.522, 243.523, 243.524, 243.529
See application file for complete search history.

(56) References Cited

U.S. PATENT DOCUMENTS

| | | | | |
|---|---|---|---|---|
| 3,144,158 | A | | 8/1964 | Nouvelet |
| 3,254,522 | A | | 6/1966 | Elliott et al. |
| 3,363,445 | A | | 1/1968 | Sanders et al. |
| 3,451,248 | A | | 6/1969 | Bell |
| 3,491,578 | A | | 1/1970 | Biermann |
| 4,005,598 | A | | 2/1977 | Ehmann et al. |
| 4,117,710 | A | | 10/1978 | Fluester |
| 4,347,728 | A | | 9/1982 | Smith |
| 4,615,206 | A | | 10/1986 | Rosier |
| 4,796,455 | A | | 1/1989 | Rosier |
| 4,813,261 | A | * | 3/1989 | Rosier ..... 29/243.522 |
| 4,815,310 | A | | 3/1989 | Summerlin et al. |
| 4,896,522 | A | * | 1/1990 | Rosier ..... 29/243.521 |
| 4,910,992 | A | | 3/1990 | Stenberg et al. |
| 4,936,134 | A | | 6/1990 | Donnelly |
| 4,989,442 | A | | 2/1991 | Rosier |
| 5,136,873 | A | | 8/1992 | Hopkins et al. |
| 5,208,959 | A | | 5/1993 | Rosier et al. |
| 5,490,311 | A | | 2/1996 | Rosier |
| 5,551,301 | A | | 9/1996 | Cowan |
| 5,575,051 | A | | 11/1996 | Moore |
| 6,449,822 | B1 | | 9/2002 | Gilbert et al. |
| 6,704,986 | B1 | | 3/2004 | Liu |
| 6,739,170 | B1 | | 5/2004 | Rosier |
| 6,817,074 | B2 | | 11/2004 | Lalonde et al. |
| 7,467,451 | B2 | | 12/2008 | Cobzaru et al. |
| 7,665,342 | B2 | * | 2/2010 | Cobzaru et al. ..... 72/391.2 |

* cited by examiner

*Primary Examiner* — David B Jones
(74) *Attorney, Agent, or Firm* — Clark Hill PLC

(57) ABSTRACT

The invention provides a system configured to adjust a jaw gripping force of a pulling head. A locking nut is threadedly attached to the pulling head and defines an aperture which extends therethrough. A frame adaptor is at least partially positioned within the aperture of the locking nut. The frame adaptor further receives a portion of the pulling head and a piston of a power tool within an aperture thereof, with the portion and the piston engaging one another within the aperture of the frame adaptor. The portion of the pulling head is operatively associated with a jaw of the pulling head. An adjustment nut is threadedly attached to the frame adaptor. Rotation of the adjustment nut, with the locking nut in an unlocked position, causes the jaw gripping force of the pulling head to either be strengthened or weakened, depending on the direction of rotation.

27 Claims, 6 Drawing Sheets

JAW GRIP FORCE ADJUSTMENT SYSTEM FOR OFFSET AND 90 DEGREE PULLING HEADS

FIELD OF THE INVENTION

This invention is generally directed to a jaw grip force adjustment system for offset pulling heads. It is also directed to an improved 360 degree swivel system for offset and right angle pulling heads.

BACKGROUND OF THE INVENTION

Aerospace blind fasteners are widely used in aircraft manufacturing. There are many different types and sizes that are used, based on the material or strength characteristics required. These blind fasteners are typically comprised of a sleeve, a stem and some type of locking mechanism. The stem of a fastener is gripped by jaws inside of a pulling head, while the sleeve of the fastener is biased against the front of the pulling head housing. The fasteners are installed by placing them in a hole prepared in the aircraft structure and pulling on a protruding stem accessible on the non-blind side.

The stem typically features a series of annular grooves, called serrations, which are to be engaged by the jaws of the pulling head used to install them. During installation, the stem is pulled away from the structure. While applying this pulling load to the stem, some type of deformation occurs on the blind side of the structure or inside of the hole, depending on the particular type of fastener used. Toward the end of the fastener installation cycle, a locking ring is deformed in place which locks the fastener in an installed position and the stem separates from the fastener.

The pulling heads generally used to install blind fasteners are comprised of a draw-bolt containing a set of jaws, and a housing that sets the locking mechanism and provides support to the fastener during installation.

In aerospace blind fastening systems, the gripping force provided by the jaws is very important for proper fastener installation—too little force causes slippage leading to installation failures and too much force makes it difficult to use the tool, which also causes productivity and tool wear issues. Straight pulling heads can easily be adjusted for the amount of grip the jaws provide, however offset or 90 degree pulling heads presently on the market do not provide adjustments for the grip of the jaws. For instance, the Cherry Aerospace Single Jaw Offset Pulling Head H781-456 is a popular tool with the aircraft manufacturers because of its low profile and its ability to reach into very tight areas. This tool, however, does not have a jaw grip adjustment so it sometimes has problems installing smaller diameter fasteners.

In order to address this issue, complicated set-up processes have been devised to try and address the slippage issue. However, despite the foregoing, the underlying problem coming from lack of proper adjustment still exists.

The present invention overcomes problems presented in the prior art and provides additional advantages over the prior art. More particularly, the present invention has been developed to address stem slippage issues inherent to the offset and 90 degree pulling heads, which has limited their usage. Such advantages will become clear upon a reading of the attached specification in combination with a study of the drawings.

SUMMARY OF THE INVENTION

Briefly, the present invention discloses an adjustment system configured to adjust a jaw gripping force of a pulling head connected to a power tool. The adjustment system has a locking nut configured to be threadedly attached to the pulling head. The locking nut defines an aperture which extends therethrough. The adjustment system further has a frame adaptor which is configured to be at least partially positioned within the aperture of the locking nut. The frame adaptor is further configured to receive a portion of the pulling head and a piston of the power tool within an aperture thereof, with the portion and the piston engaging one another within the aperture of the frame adaptor. The portion of the pulling head is operatively associated with a jaw of the pulling head. The adjustment system further has an adjustment nut which is configured to be threadedly attached to the frame adaptor.

In use, when the locking nut is in an unlocked position, the adjustment nut can be rotated in a counterclockwise manner in order to strengthen the jaw gripping force of the pulling head by causing the portion of the pulling head to move toward the power tool. Alternatively, when the locking nut is in an unlocked position, the adjustment nut can be rotated in a clockwise manner in order to weaken the jaw gripping force of the pulling head by causing the portion of the pulling head to move away from the power tool.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
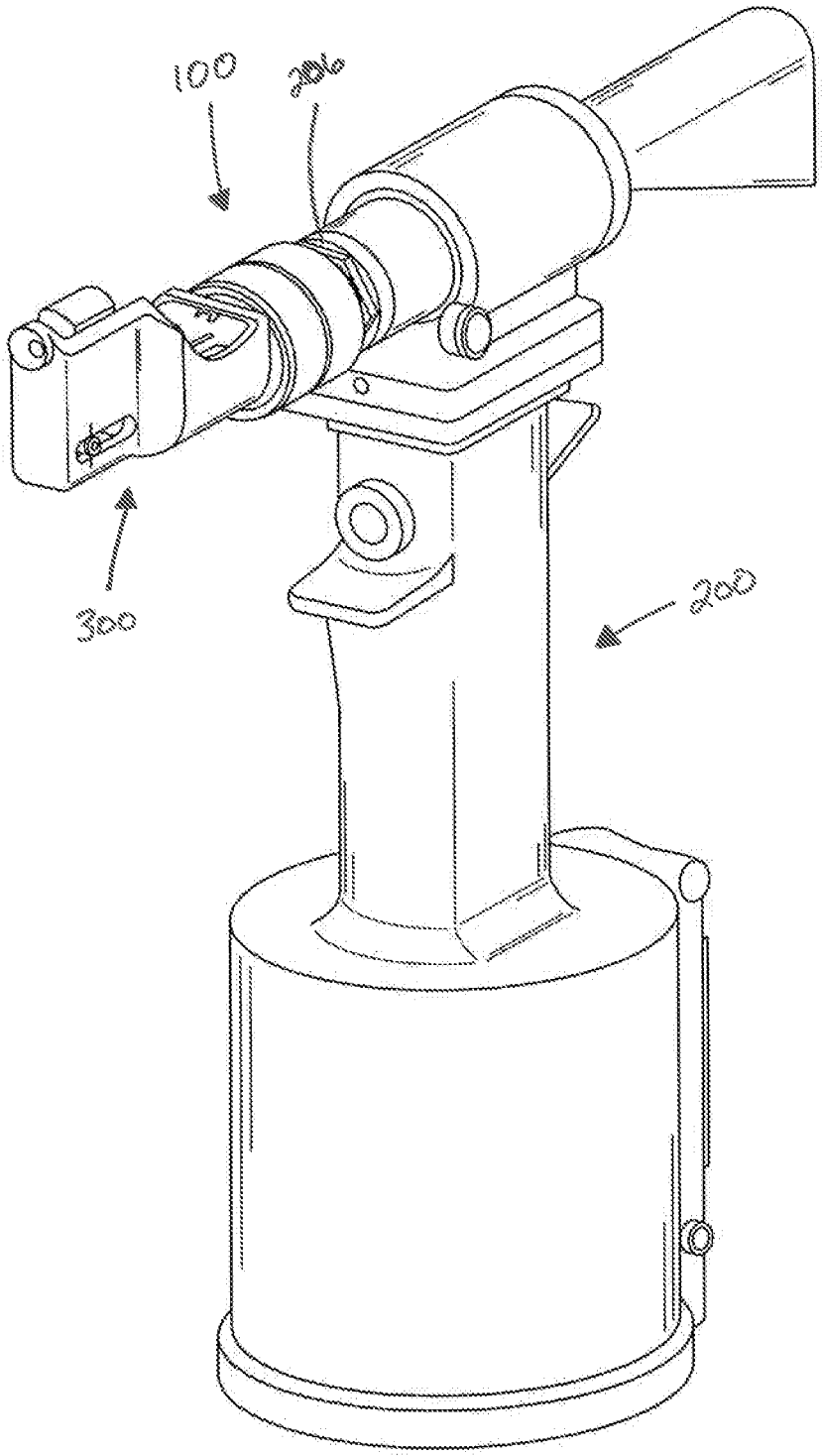
FIG. 1 is a perspective view of a power tool, an adjustment assembly and a pulling head in an assembled manner.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
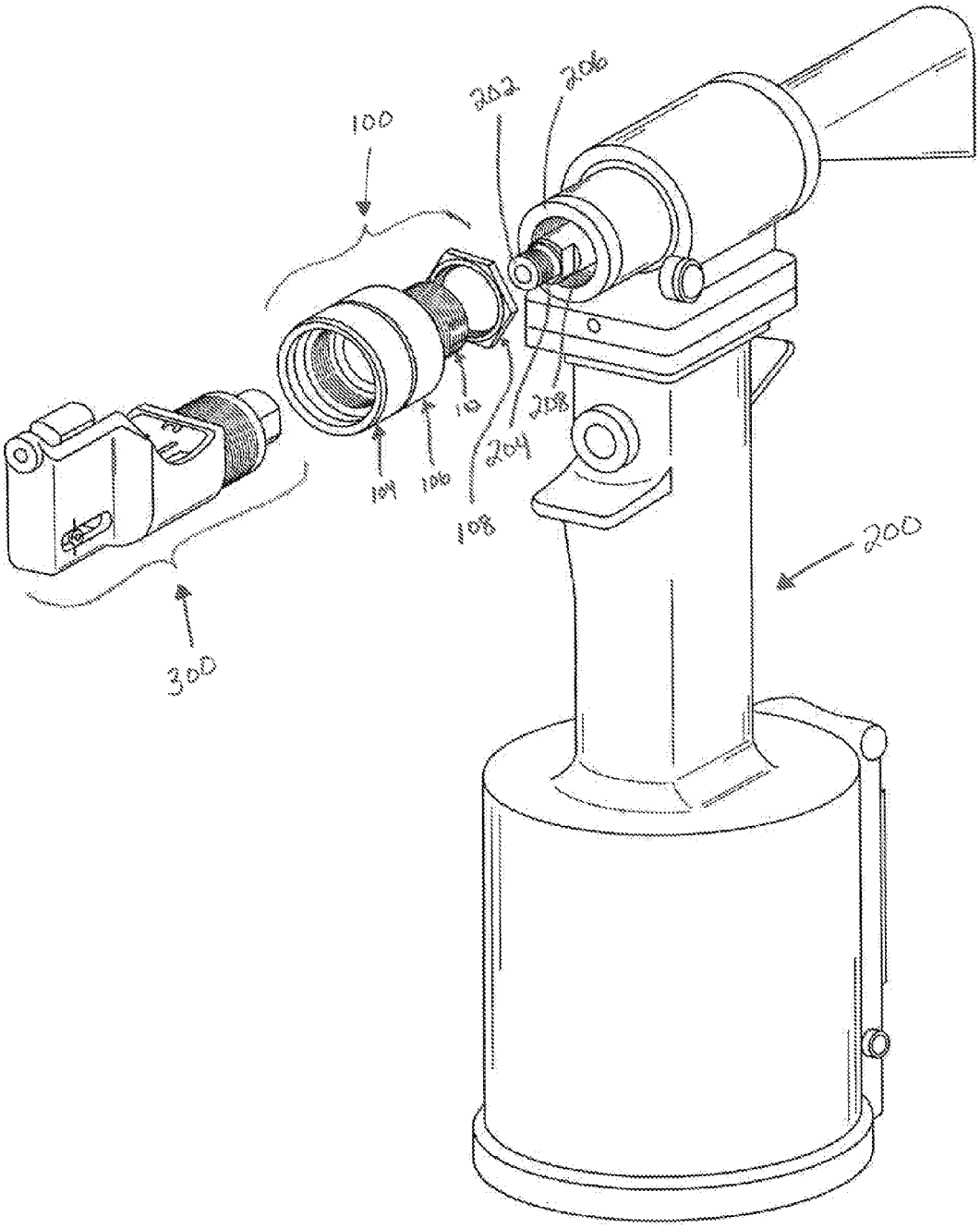
FIG. 2 is an exploded perspective view of a power tool, an adjustment assembly and a pulling head in an unassembled manner.
Figure 3:
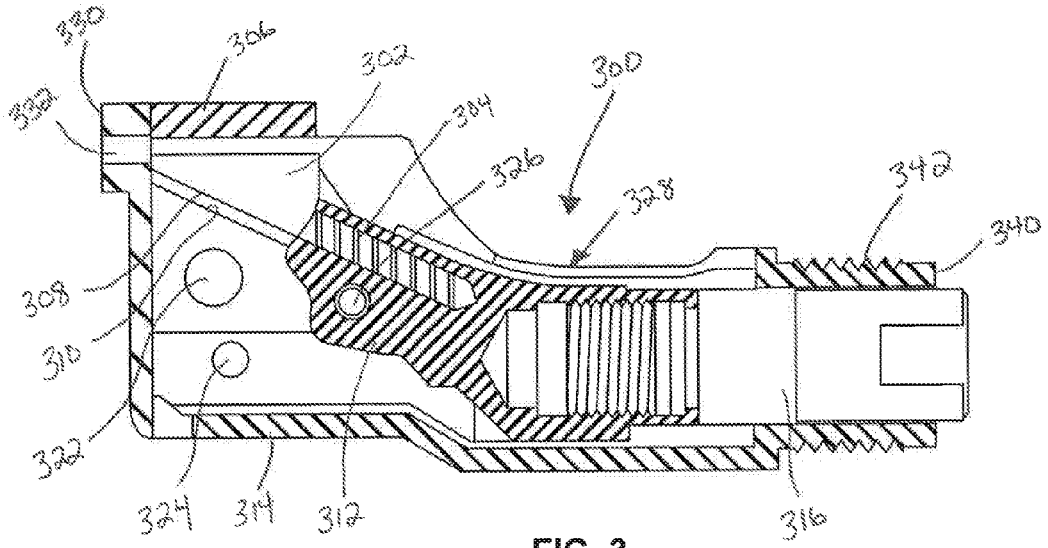
FIG. 3 is a cross-sectional view of a prior art single jaw offset pulling head.
Figure 4:
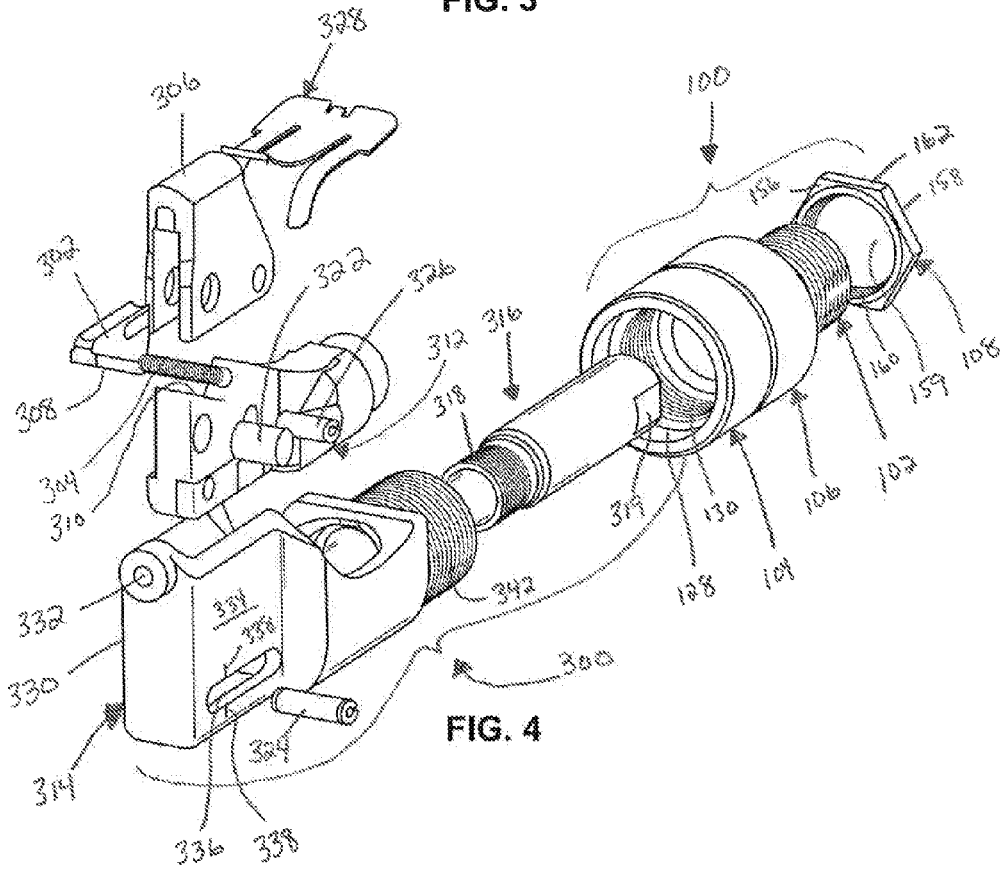
FIG. 4 is an exploded perspective view of the prior art single jaw offset pulling head shown in FIG. 3 and the adjustment assembly.

The invention provides for a jaw grip force adjustment system 100, which is best illustrated in FIGS. 2 and 4. The jaw grip force adjustment system 100 further acts as an adaptor from a power tool 200, such as a riveter, to a pulling head 300, which is preferably an offset pulling head, as illustrated in FIG. 3, or a 90 degree puling head (not shown).

FIGS. 1 and 2 illustrate a typical power tool 200, such as a riveter. The power tool 200 is a known device and, therefore, will not be described in any detail, except to describe and illustrate parts of the power tool 200 that interact with the jaw grip force adjustment system 100 and the pulling head 300. The power tool 200 includes a piston 202 which has an outer threaded surface 204. The power tool 200 further includes a head 206 which has an inner threaded surface 208. The inner threaded surface 208 defines an inner diameter of the head 206 which is larger than an outer diameter defined by the outer threaded surface 204 of the piston 202.

FIGS. 3 and 4 illustrate a prior art single jaw offset pulling head 300. Specifically, FIG. 3 provides a cross-sectional view, while FIG. 4 provides an exploded perspective view. As shown, the device provides a single jaw 302 which is biased by a spring 304 inside a drawbolt saddle 306. The jaw 302 has an angled surface 308 which engages a corresponding angled surface 310 on a drawbolt 312. The drawbolt 312 is disposed generally in a frame 314 of the pulling head 300, and a drawbolt adaptor 316 is threadably engaged with the drawbolt 312. The drawbolt adaptor 316 has first and second opposite ends 318, 319. The first end 318 of the drawbolt adaptor 316 is threadably engaged with the drawbolt 312. The drawbolt adaptor 316 further includes a recess (not shown) at the second end 319 which defines a threaded inner surface (not shown) of the drawbolt adaptor 316.

In addition, the pulling head 300 includes a dowel pin 322 for securing the drawbolt saddle 306 to the drawbolt 312, a roll pin 324 for facilitating sliding of the drawbolt 312 relative to the frame 314, a roll pin 326 for anchoring the drawbolt saddle 306 to the drawbolt 312, and a guard 328 for enclosing an otherwise exposed portion of the pulling head 300. The roll pin 324 preferably extends through the drawbolt 312 such that its ends extend beyond the drawbolt 312. A front end 330 of the frame 314 of the pulling head 300 has an opening 332 for receiving a stem of a fastener (not shown) that is desired to be installed, such that the stem can be gripped by the jaw 302 inside the pulling head 300. Sides 334 of the frame 314 of the pulling head 300 have slots 336 for receiving the ends of the roll pin 324 in order to facilitate sliding of the drawbolt 312 relative to the frame 314 and to allow for visual inspection of the roll pin 324, and thus the location of the drawbolt 312, relative to the frame 314. At least one of the sides 334 of the frame 314 also further preferably includes adjustment marks 338 above and/or below the slots 336. These adjustment marks 338 are provided at a location along the slots 336 where full jaw gripping force is achieved, as will be discussed in further detail hereinbelow during a description of the operation. An outer threaded surface 342 of the frame 314 of the pulling head 300 is defined proximate a rear end 340 of the frame 314 of the pulling head 300.

The jaw grip force adjustment system 100 is best illustrated in FIGS. 2 and 4-6. The adjustment system 100 comprises a frame adaptor 102, a locking nut 104, an adjustment nut 106, and a jam nut 108.

Figure 5:
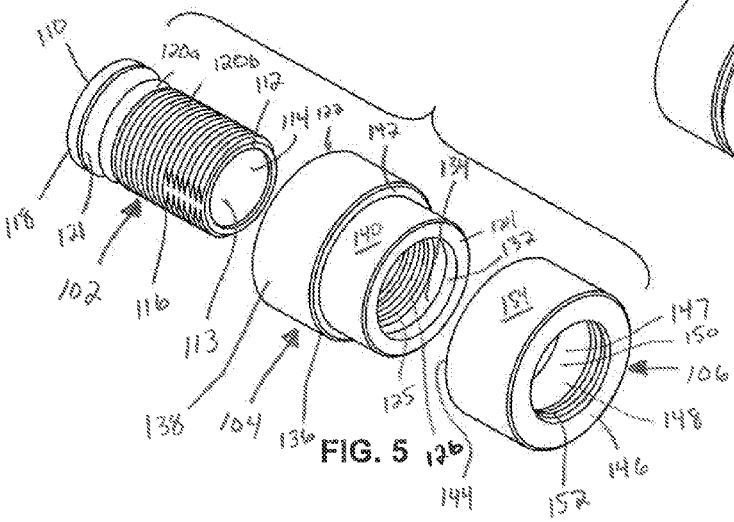
FIG. 5 is an exploded perspective view of the adjustment assembly, without the jam nut.

The frame adaptor 102 is best illustrated in FIG. 5. The frame adaptor 102 is generally cylindrical in configuration and extends from a first end 110 to a second end 112. The frame adaptor 102 has an aperture 113 provided therethrough which extends from the first end 110 to the second end 112. The aperture 113 defines a generally cylindrical inner surface 114, preferably of a constant diameter. The frame adaptor 102 further defines a generally cylindrical outer surface 116 which extends from the first end 110 to the second end 112. The generally cylindrical outer surface 116 has a first diameter portion 118 proximate to the first end 110 and a second diameter portion 120 proximate to said second end 112. The first diameter portion 118 is larger than the second diameter portion 120 such that a shoulder 121 is defined between the first and second diameter portions 118, 120. The second diameter portion 120 provides a thread relief portion **120*a* provided proximate to the shoulder 121 and a threaded portion 120*b* from the thread relief portion 120*a* to the second end 112**.

The locking nut 104 is best illustrated in FIG. 5. The locking nut 104 is generally cylindrical in configuration and extends from a first end 122 to a second end 124. The locking nut 104 has an aperture 125 provided therethrough which extends from the first end 122 to the second end 124. The aperture 125 defines a generally cylindrical inner surface 126. The generally cylindrical inner surface 126 has first, second and third diameter portions 128, 130, 132. The first diameter portion 128 is provided proximate to the first end 122, the third diameter portion 132 is provided proximate to the second end 124, and the second diameter portion 130 is provided between the first and third diameter portions 128, 132. The first and second diameter portions 128, 130 have approximately the same diameter, but the second diameter portion 130 is threaded. The third diameter portion 132 has a diameter which is less than the diameter of the second diameter portion 130, such that a shoulder 134 is defined between the second and third diameter portions 130, 132.

The locking nut 104 further defines a generally cylindrical outer surface 136 which extends from the first end 122 to the second end 124. The generally cylindrical outer surface 136 has first and second diameter portions 138, 140. The first diameter portion 138 is provided proximate to the first end 122 and the second diameter portion 140 is provided proximate to the second end 124. The first diameter portion 138 has a diameter which is larger than a diameter of the second diameter portion 140, such that a shoulder 142 is defined between the first and second diameter portions 138, 140. The first diameter portion 138 preferably is not smooth, but rather is configured in such a manner as to aid a user to grip the first diameter portion 138 of the generally cylindrical outer surface 136 of the locking nut 104.

The adjustment nut 106 is best illustrated in FIG. 5. The adjustment nut 106 is generally cylindrical in configuration and extends from a first end 144 to a second end 146. The adjustment nut 106 has an aperture 147 provided therethrough which extends from the first end 144 to the second end 146. The aperture 147 defines a generally cylindrical inner surface 148. The generally cylindrical inner surface 148 has first and second diameter portions 150, 152. The first diameter portion 150 is provided proximate to the first end 144, and the second diameter portion 152 is provided proximate to the second end 146. The first and second diameter portions 150, 152 have approximately the same diameter, but the second diameter portion 152 is threaded.

The adjustment nut 106 further defines a generally cylindrical outer surface 154 which extends from the first end 144 to the second end 146. The generally cylindrical outer surface 154 preferably has a constant diameter from the first end 144 to the second end 146. The generally cylindrical outer surface 154 preferably is not smooth, but rather is configured in such a manner as to aid a user to grip the generally cylindrical outer surface 154 of the adjustment nut 104.

The jam nut 108 is best illustrated in FIG. 4. The jam nut 108 extends from a first end 156 to a second end 158. The jam nut 108 has an aperture 159 provided therethrough which extends from the first end 156 to the second end 158. The aperture 159 defines a generally cylindrical inner surface 160. The generally cylindrical inner surface 160 is preferably threaded. The jam nut 108 further defines an outer surface 162 which extends from the first end 156 to the second end 158. The outer surface 162 is preferably formed in a hex shape such that it can be gripped and rotated by an appropriate tool, such as a wrench. It is to be understood that the outer surface 162 of the jam nut 108 could be formed in any other appropriate configuration.

Figure 6:
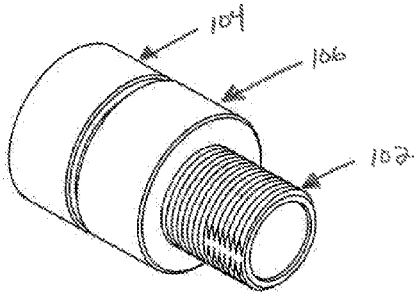
FIG. 6 is a perspective view of the adjustment assembly, without the jam nut, shown in FIG. 5.

The assembly of the adjustment system 100 is best illustrated in FIGS. 1 and 6. The second end 112 of the frame adaptor 102 is inserted into the aperture 125 of the locking nut 104 from the first end 122 of the locking nut 104 until the shoulder 121 of the generally outer cylindrical surface 116 of the frame adaptor 102 abuts against the shoulder 134 of the generally inner cylindrical surface 126 of the locking nut 104. With the shoulders 121, 134 abutting one another, the second end 112 of the frame adaptor 102, the threaded portion 120*b* of the second diameter portion 120, and a portion of the thread relief 120*a* of the second diameter portion 120 of the generally cylindrical outer surface 116 of the frame adaptor 102 extend beyond the second end 124 of the locking nut 104. The frame adaptor 102 and the locking nut 104 are capable of rotating relative to one another.

The second end 112 of the frame adaptor 102 is then inserted into the aperture 147 of the adjustment nut 106 from the first end 144 of the adjustment nut 106 until the threaded portion 120*b* of the second diameter portion 120 of the generally cylindrical outer surface 116 of the frame adaptor 102 comes into contact with the threaded second diameter portion 152 of the generally cylindrical inner surface 148 of the adjustment nut 106. The frame adaptor 102 and the adjustment nut 106 are then threadedly engaged with one another until the first end 144 of the adjustment nut 106 is tightened against the thread relief 120*a*. The end of the frame adaptor 102 may be provided with flats 119 which are used to hold the frame adaptor 102 while tightening the adjustment nut 106. A high strength thread locker is preferably used to permanently lock the adjustment nut 106 to the frame adaptor 102. Alternatively, deforming the thread or spot welding may achieve the same goal. With the adjustment nut 106 permanently locked to the frame adaptor 102, the first diameter portion 150 of the generally cylindrical inner surface 148 of the adjustment nut 106 is positioned around the second diameter portion 140 of the generally cylindrical outer surface 136 of the locking nut 104. The second end 112 of the frame adaptor 102 and a portion of the threaded portion 120*b* of the second diameter portion 120 of the generally cylindrical outer surface 116 of the frame adaptor 102 also extend beyond the second end 146 of the adjustment nut 106.

The second end 112 of the frame adaptor 102 is then inserted into the aperture 159 of the jam nut 108 from the first end 156 of the jam nut 108 and the threaded portion 120*b* of the second diameter portion 120 of the generally cylindrical outer surface 116 of the frame adaptor 102 is threadedly engaged with the jam nut 108 until; at least, the second end 112 of the frame adaptor 102 extends beyond the second end 158 of the jam nut 108.

The adjustment system 100 is then connected to the pulling head 300 and the jam nut 108 is threaded toward the adjustment nut 106. In order to connect the adjustment system 100 to the pulling head 300, the outer threaded surface 342 of the frame 314 of the pulling head 300 and the threaded second diameter portion 130 of the generally cylindrical inner surface 126 of the lock nut 104 are threadedly engaged with one another.

The assembly of the adjustment system 100 and the pulling head 300 is then threaded onto the power tool 200. In order to connect the assembly to the power tool 200, the threaded portion 120*b* of the second diameter portion 120 of the generally cylindrical outer surface 116 of the frame adaptor 102 and the inner threaded surface 208 of the head 206 of the power tool 200 are threadedly engaged with one another, and the threaded inner surface (not shown) of the drawbolt adaptor 316 and the outer threaded surface 204 of the piston 202 of the power tool 200 are threadedly engaged with one another. Once these two threaded engagements are made, the jam nut 108 is threaded against the head 206 of the power tool 200.

In use, a stem of a fastener (not shown) that is desired to be set is inserted into the opening 332 which is provided in the front end 330 of the frame 314 of the pulling head 300. While the jaw 302 is spring biased closed by the spring 304, when the stem is inserted into the opening 332, the stem pushes the jaw 302 open and the jaw 302 springs back against the stem and becomes seated against the stem. Then, the power tool 200 is actuated causing the piston 202 to be pulled back, thereby pulling on the drawbolt adaptor 316. Pulling on the drawbolt adaptor 316 causes the drawbolt 312 and the drawbolt saddle 306 to move back in the frame 314 (i.e., in a direction away from the opening 332 in the front end 330 of the frame 314). Due to the fact that the jaw 302 has an angled surface 308 which engages a corresponding angled surface 310 on the drawbolt 312, movement of the drawbolt 312 in a direction away from the opening 332 in the front end 330 of the frame 314 causes the jaw 302 to grip and effectively lock on the stem of the fastener, whereby further actuation of the power tool 200 eventually causes the stem to be pulled sufficiently such that the fastener sets and the stem breaks off.

As explained above, with the adjustment system 100 connected to both the power tool 200 and to the pulling head 300, the adjustment system 100 may be manipulated in order to adjust the jaw gripping force depending on the size of the fastener to be set, as illustrated in FIGS. 7-14. More specifically, the adjustment system 100 allows for adjustment between the two main components of the pulling head 300, namely, the drawbolt 312 and the frame 314. Since there is full adjustment, no special assembly instructions need to be followed by users when the pulling head 300 is installed to the power tool 200.

Figure 7:
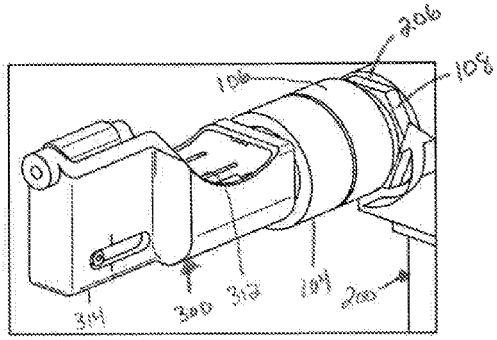
FIGS. 7-14 are perspective and side views of the power tool, the adjustment assembly and the pulling head being operatively associated with one another and illustrating the steps for adjusting a jaw gripping force of the pulling head.

For smaller sized fasteners, for instance those having a diameter of ⅛ inch or less, a stronger jaw gripping force is required. For these smaller sized fasteners, the jaw gripping force can be appropriately adjusted by first unlocking and threading the jam nut 108 away (in a counter-clockwise direction) from the head 206 of the power tool 200, as illustrated in FIG. 7.

Figure 8:
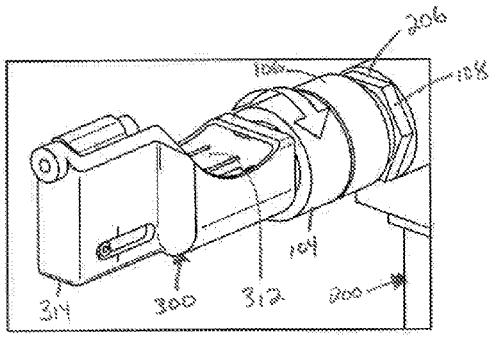

The locking nut 104 is then unlocked by turning the locking nut 104 (in a clockwise direction) relative to the outer threaded surface 342 of the rear end 340 of the frame 314 of the pulling head 300, as illustrated in FIG. 8. Preferably, the locking nut 104 should not be rotated more than ½ turn.

Figure 9:
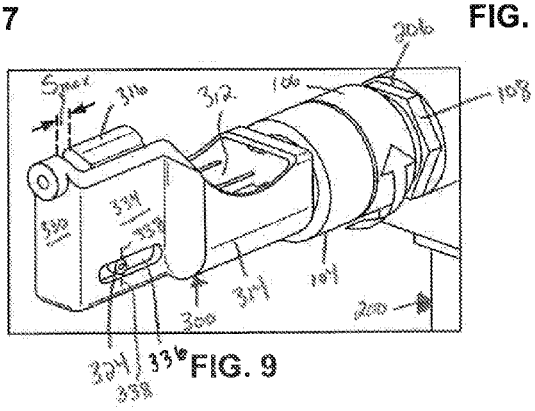
Figure 10:
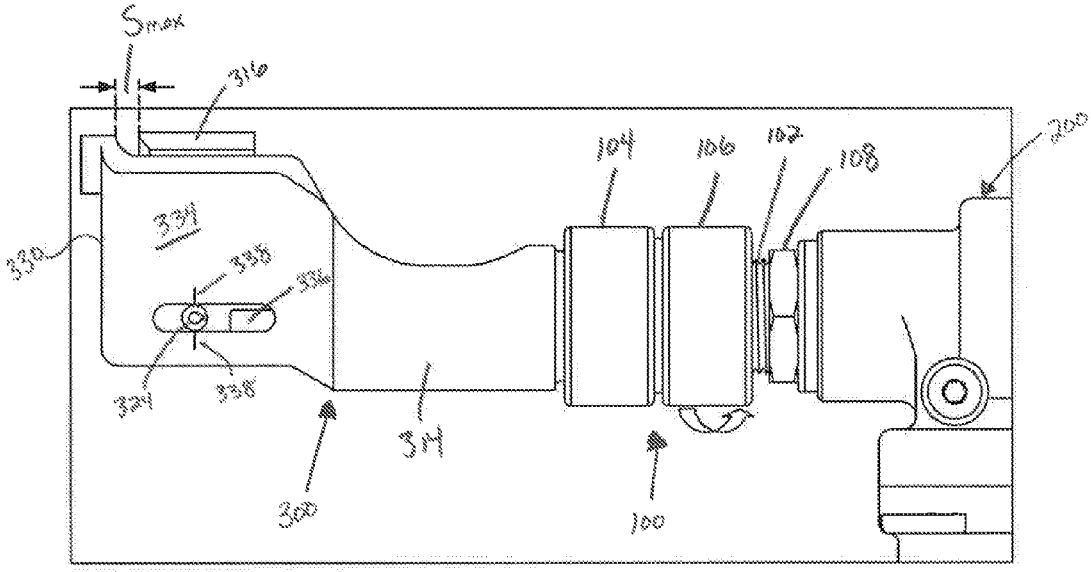

Next, while holding the frame 314 of the pulling head 300 stationary, the adjustment nut 106 is rotated counterclockwise, as illustrated in FIGS. 9 and 10. This counterclockwise rotation of the adjustment nut 106 causes the drawbolt 312 to move rearward within the frame 314 of the pulling head 300, thus causing the roll pin 324 to move rearward within the slots 336 of the sides 334 of the frame 314 and causing the drawbolt adaptor 316 to move away from the front end 330 of the frame 314. The more space $S_{max}$ which is provided between a front end of the drawbolt adaptor 316 and the front end 330 of the frame 314, the more the jaw 302 can close, thereby generating more gripping force. Maximum gripping force is obtained when the roll pin 324 is positioned in the slots 336 in alignment with the adjustment marks 338. Once the maximum gripping force is achieved, further counter-clockwise of the adjustment nut 106, such that the roll pin 324 is positioned in the slots 336 beyond the adjustment marks 338 and distal from the front end 330 of the frame 314, will not increase the jaw grip force any further, but it will decrease the stroke significantly.

Figure 11:
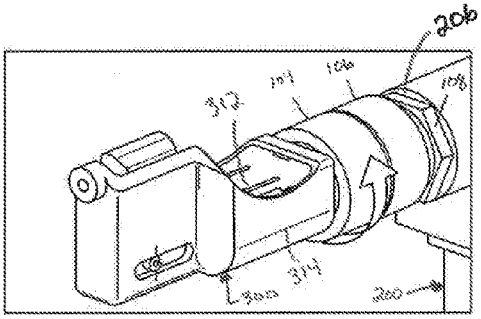

With the jaw gripping force set as desired, the frame 314 is held in the desired angular position (as will be discussed in further detail hereinbelow) and the locking nut 104 is rotated counter-clockwise to hand tight in order to lock the adjustment, as illustrated in FIG. 11.

Figure 12:
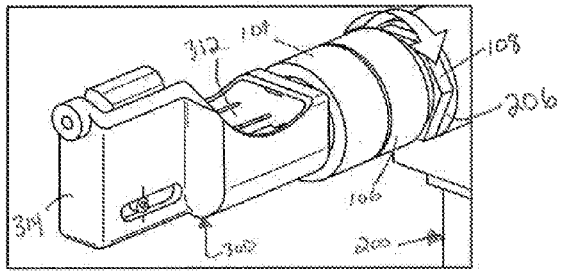

The jam nut 108 can then be rotated clockwise against the head 206 of the power tool 200 in order to lock the pulling head 300 in place, as illustrated in FIG. 12.

For larger sized fasteners, for, instance those having a diameter of 5⁄32 inch or more, a weaker jaw gripping force is required. For these larger sized fasteners, the jaw gripping force can be appropriately adjusted by first unlocking and threading the jam nut 108 away (in a counter-clockwise direction) from the head 206 of the power tool 200, as illustrated in FIG. 7.

The locking nut 104 is then unlocked by turning the locking nut 104 (in a clockwise direction) relative to the outer threaded surface 342 of the rear end 340 of the frame 314 of the pulling head 300, as illustrated in FIG. 8. Preferably, the locking nut 104 should not be rotated more than ½ turn.

Figure 13:
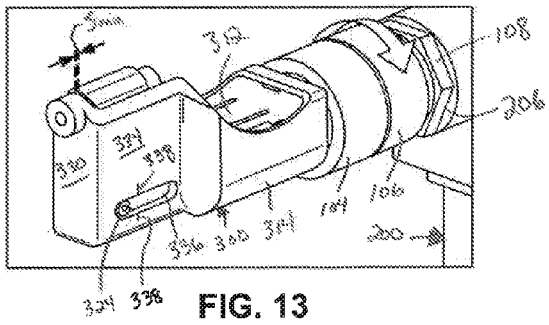
Figure 14:
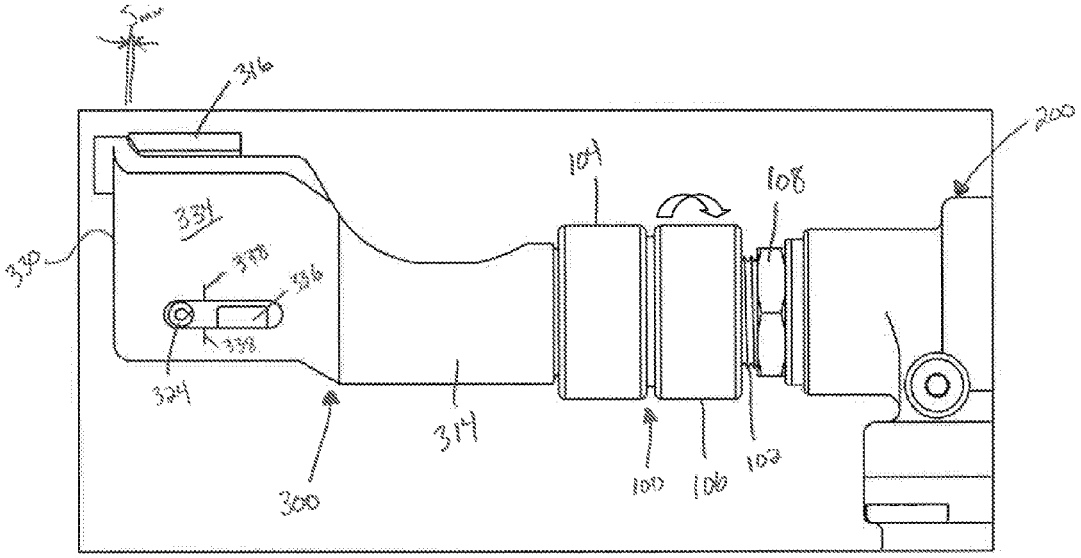

Next, while holding the frame 314 of the pulling head 300 stationary, the adjustment nut 106 is rotated clockwise, as illustrated in FIGS. 13 and 14. This clockwise rotation of the adjustment nut 106 causes the drawbolt 312 to move forward within the frame 314 of the pulling head 300, thus causing the roll pin 324 to move forward within the slots 336 of the sides 334 of the frame 314 and causing the drawbolt adaptor 316 to move toward the front end 330 of the frame 314. The less space $S_{min}$ which is provided between a front end of the drawbolt adaptor 316 and the front end 330 of the frame 314, the less the jaw 302 can close, thereby generating less gripping force. The minimum gripping force is obtained when the roll pin 324 is positioned in the slots 336 in general abutment with a forward end of the slots 336, which is provided proximal to the front end 330 of the frame 314.

With the jaw gripping force set as desired, the frame 314 is held in the desired angular position (as will be discussed in further detail hereinbelow) and the locking nut 104 is rotated counter-clockwise to hand tight in order to lock the adjustment, as illustrated in FIG. 11.

The jam nut 108 can then be rotated clockwise against the head 206 of the power tool 200 in order to lock the pulling head 300 in place, as illustrated in FIG. 12.

Thus, the process for adjusting the jaw gripping force is identical for strengthening or weakening the jaw gripping force, except for the direction in which the adjustment nut 106 is rotated, namely counter-clockwise (as illustrated in FIGS. 9 and 10) to strengthen the jaw gripping force or clockwise (as illustrated in FIGS. 13 and 14) to weaken the jaw gripping force.

Figure 15:
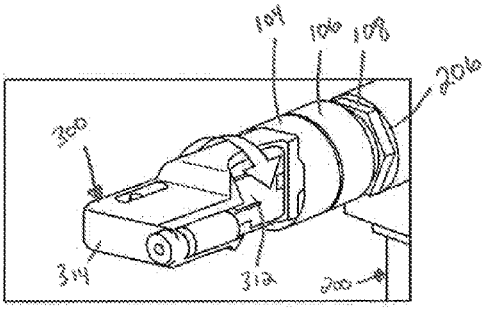
FIGS. 15 and 16 are perspective views of the power tool, the adjustment assembly and the pulling head being operatively associated with one another and illustrating the steps for adjusting an angular portion of the pulling head relative to the power tool.
Figure 16:
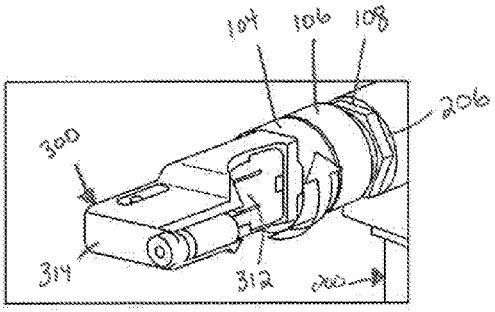

As illustrated in FIGS. 7, 15 and 16, the adjustment system 100 also allows for 360 degree adjustment of an angular position of the pulling head 300 relative to the power tool 200. This 360 degree adjustment can occur without disengaging the drawbolt 312 from the piston 202 of the power tool 200, as is required by current designs. The potential danger with these current designs is that disengaging the drawbolt 312 while controlling the orientation of the pulling head 300 can cause the piston 202 of the power tool 200 to break, thereby disabling the power tool 200. Such a break of the piston 202 can also be expensive to fix.

In order to adjust the angular position of the pulling head 300 relative to the power tool 200, the locking nut 104 is unlocked, preferably by no more than ½ turn, as illustrated in FIG. 7; the jam nut 108 is not manipulated. The pulling head 300 is then turned until the correct angular position has been reached, as illustrated in FIG. 15. The locking nut is then rotated counter-clockwise to hand tight in order to lock the adjustment, as illustrated in FIG. 16.

Thus, as discussed, the adjustment system 100 of the present invention provides a number of advantages over the prior art including the ability to operate both the locking nut 104 and the adjustment nut 106 by hand, and that adjustment can be made on the fly during use of the pulling head 300 (not only at set-up like current pulling heads).

While a preferred embodiment of the present invention is shown and described, it is envisioned that those skilled in the art may devise various modifications of the present invention without departing from the spirit and scope of the invention.

The invention claimed is:

1. An adjustment system configured to adjust a jaw gripping force of a pulling head connected to a power tool, said adjustment system comprising:

a locking nut configured to be threadedly attached to the pulling head, said locking nut defining an aperture which extends therethrough;

a frame adaptor configured to be at least partially positioned within said aperture of said locking nut, said frame adaptor further being configured to receive a portion of the pulling head and a piston of the power tool within an aperture thereof, with the portion and the piston engaging one another within said aperture of said frame adaptor, the portion of the pulling head being operatively associated with a jaw of the pulling head; and an adjustment nut configured to be rigidly attached to the frame adaptor, whereby, when said locking nut is in an unlocked position, said adjustment nut can be rotated in a counterclockwise manner in order to strengthen the jaw gripping force of the pulling head by causing the portion of the pulling head to move toward the power tool, or said adjustment nut can be rotated in a clockwise manner in order to weaken the jaw gripping force of the pulling head by causing the portion of the pulling head to move away from the power tool.

2. The adjustment system as defined in claim 1, wherein said locking nut has an inner surface which is threaded, said inner threaded surface of said locking nut being configured to be threadedly engaged to an outer threaded surface of the pulling head.

3. The adjustment system as defined in claim 1, wherein said locking nut has an inner surface which defines a shoulder, and wherein said frame adaptor has an outer surface which defines a shoulder, said frame adaptor being prevented from moving out of said aperture of said locking nut due to abutment of said shoulder of said outer surface of said frame adaptor against said shoulder of said inner surface of said locking nut.

4. The adjustment system as defined in claim 1, wherein said frame adaptor has an outer surface which is threaded, and wherein said adjustment nut has an inner surface which is threaded, said inner threaded surface of said adjustment nut being configured to be threadedly engaged to said outer threaded surface of said frame adaptor.

5. The adjustment system as defined in claim 4, further comprising a jam nut which has an inner surface which is threaded, said inner threaded surface of said jam nut being configured to be threadedly engaged to said outer surface of said frame adaptor.

6. A combination comprising:

a pulling head having a frame having first and second ends and a jaw gripping assembly which is generally positioned within said frame; said first end of said frame being configured to receive a stem of a fastener therein; and an adjustment assembly which is configured to be connected to both said frame and said jaw gripping assembly, said adjustment assembly being configured to be manipulated in a first manner in order to move said jaw gripping assembly closer to said first end of said frame in order to minimize an amount of jaw grip force generated by said jaw gripping assembly, said adjustment assembly being configured to be manipulated in a second manner in order to move said jaw gripping assembly distal to said first end of said frame in order to maximize an amount of jaw grip force generated by said jaw gripping assembly.

7. The combination as defined in claim 6, wherein said frame has a slot provided therethrough, and wherein said jaw gripping assembly has a member extending therefrom which is positioned within said slot of said frame, said position of said member within said slot providing a visual indicator of the amount of jaw grip force that will be generated by said jaw gripping assembly.

8. The combination as defined in claim 7, wherein said slot has a first end proximate to said first end of said frame and a second end distal to said first end of said frame, wherein when said member is positioned at said first end of said slot, a minimal amount of jaw grip force is generated by said jaw gripping assembly.

9. The combination as defined in claim 8, wherein said frame has an adjustment mark provided between said first and second ends of said slot, wherein when said member is positioned in alignment with said adjustment mark, a maximum amount of jaw grip force is generated by said jaw gripping assembly.

10. The combination as defined in claim 6, wherein said second end of said frame has an outer surface which is threaded, and wherein said adjustment assembly has a locking nut which has an inner surface which is threaded, said inner threaded surface of said locking nut being threadedly engaged to said outer threaded surface of said frame in order to connect said adjustment assembly to said frame.

11. The combination as defined in claim 10, wherein said adjustment assembly has a frame adaptor which is partially positioned within, and rotatable relative to, said locking nut.

12. The combination as defined in claim 11, wherein a portion of said frame adaptor which is not positioned within said locking nut has an outer surface which is threaded, and wherein said adjustment assembly further has an adjustment nut which has an inner surface which is threaded, said inner threaded surface of said locking nut being threadedly engaged to said outer threaded surface of said frame adaptor.

13. The combination as defined in claim 12, wherein said adjustment assembly further comprises a jam nut having an inner surface which is threaded, said inner threaded surface of said jam nut being threadedly engaged to said outer threaded surface of said frame adaptor, said jam nut configured to be tightened against a power tool.

14. The combination as defined in claim 6, further comprising a power tool having a piston and a head, said jaw gripping assembly being operatively associated with said piston of said power tool, said adjustment assembly configured to have a portion thereof which is locked against said head of said power tool in order to lock said pulling head in place.

15. A method of adjusting a jaw gripping force of a pulling head, said method comprising:

a) providing a power tool having a piston and a head;

b) providing a pulling head having a frame having first and second ends and a jaw gripping assembly which is generally positioned within said frame; said first end of said frame being configured to receive a stem of a fastener therein, said piston of said power tool being secured to a portion of said jaw gripping assembly of said pulling head; and c) providing an adjustment assembly having a locking nut, an adjustment nut, a jam nut and a frame adaptor, said locking nut being locked to said second end of said frame, said frame adaptor being partially positioned within, and being rotatable relative to, said locking nut, said adjustment nut being secured to a portion of said frame adaptor positioned outside of said locking nut, said jam nut being secured to said portion of said frame adaptor positioned outside of said locking nut and being locked against said head of said power tool;

d) unlocking said jam nut away from said head of said power tool;

e) unlocking said locking nut from said frame of said pulling head; and f) rotating said adjustment nut to a desired position which causes said jaw gripping assembly to move to a desired position within said frame.

16. The method as defined in claim 15, further comprising the steps of:

g) locking said locking nut to said frame of said pulling head after performing step (f); and h) locking said jam nut against said head of said power tool.

17. The method as defined in claim 16, wherein step (g) is performed while holding said frame in a desired angular position relative to said power tool and by rotating said locking nut in a counter-clockwise direction until said locking nut is locked tight against said frame.

18. The method as defined in claim 16, wherein step (h) is performed by rotating said jam nut in a clockwise direction until said jam nut is locked tight against said head of said power tool.

19. The method as defined in claim 15, wherein step (d) is performed by rotating said jam nut in a counter-clockwise direction until said jam nut is unlocked from, and positioned away from, said head of said power tool.

20. The method as defined in claim 15, wherein step (e) is performed by rotating said locking nut in a clockwise direction until said locking nut is unlocked from said frame.

21. The method as defined in claim 20, wherein said locking nut is rotated in a clockwise direction for no more than ½ turn.

22. The method as defined in claim 15, wherein step (f) is performed by holding said frame stationary and by rotating said adjustment nut in a counter-clockwise direction, thereby causing said jaw gripping assembly to move away from said first end of said frame in order to provide said jaw gripping assembly with a stronger jaw grip.

23. The method as defined in claim 15, wherein step (f) is performed by holding said frame stationary and by rotating said adjustment nut in a clockwise direction, thereby causing said jaw gripping assembly to more toward said first end of said frame in order to provide said jaw gripping assembly with a weaker jaw grip.

24. A method of adjusting an angular position of a pulling head, said method comprising:

a) providing a power tool having a piston and a head;

b) providing a pulling head having a frame having first and second ends and a jaw gripping assembly which is generally positioned within said frame; said first end of said frame being configured to receive a stem of a fastener therein, said piston of said power tool being secured to a portion of said jaw gripping assembly of said pulling head; and c) providing an adjustment assembly having a locking nut, a jam nut and a frame adaptor, said locking nut being locked to said second end of said frame, said frame adaptor being partially positioned within, and being rotatable relative to, said locking nut, said jam nut being secured to said portion of said frame adaptor positioned outside of said locking nut and being locked against said head of said power tool;

d) unlocking said locking nut from said frame of said pulling head;

e) turning said pulling head to a desired angular position relative to said power tool; and f) locking said locking nut to said frame of said pulling head.

25. The method as defined in claim 24, wherein step (d) is performed by rotating said locking nut in a clockwise direction until said locking nut is unlocked from said frame.

26. The method as defined in claim 25, wherein said locking nut is rotated in clockwise direction for no more than ½ turn.

27. The method as defined in claim 24, wherein step (f) is performed by holding said frame in said desired angular position relative to said power tool and by rotating said locking nut in a counter-clockwise direction until said locking nut is locked tight against said frame.

* * * * *